US005630355A

United States Patent [19]

Ikeda et al.

[11] Patent Number: 5,630,355

[45] Date of Patent: May 20, 1997

[54] RECIPROCATING TYPE COMPRESSOR WITH IMPROVED CYLINDER BLOCK

[75] Inventors: Hayato Ikeda; Hiromi Nagata; Yuji Kaneshige; Masaaki Nishimoto, all of Kariya, Japan

[73] Assignee: Kabushiki Kaisha Toyoda Jidoshokki Seisakusho, Aichi, Japan

[21] Appl. No.: 580,535

[22] Filed: Dec. 29, 1995

Related U.S. Application Data

[63] Continuation of Ser. No. 261,829, Jun. 17, 1995, abandoned.

[30] Foreign Application Priority Data

Jun. 21, 1993 [JP] Japan ..... 5-174882

[51] Int. Cl.[6] ..... F01B 11/02

[52] U.S. Cl. ..... 92/169.1; 92/71; 29/888.06; 417/269

[58] Field of Search ..... 92/169.1, 71; 29/888.02, 29/888.06, 888.061; 417/269

[56] References Cited

U.S. PATENT DOCUMENTS

| | | | |
|---|---|---|---|
| 4,077,810 | 3/1978 | Ohuchi et al. | 148/2 |
| 4,650,644 | 3/1987 | Huret et al. | 419/11 |
| 5,056,417 | 10/1991 | Kato et al. | 92/71 |
| 5,057,274 | 10/1991 | Futamura et al. | 420/534 |
| 5,217,546 | 6/1993 | Eady et al. | 148/549 |

FOREIGN PATENT DOCUMENTS

| | | |
|---|---|---|
| 2408276 | 8/1975 | Germany . |
| 3904240 | 8/1989 | Germany . |
| 60-56057 | 4/1985 | Japan . |
| 60-70160 | 4/1985 | Japan . |
| 62-51776 | 3/1987 | Japan . |
| 441261 | 9/1992 | Japan . |
| 4-41261 | 9/1992 | Japan . |

*Primary Examiner*—Thomas E. Denion
*Attorney, Agent, or Firm*—Burgess, Ryan & Wayne

[57] ABSTRACT

It is an object of the present invention to secure excellent slidability between a piston and cylinder bore even under severe running conditions.

Cylinder blocks are made of aluminum alloy comprising, by weight, 1.5 to 5.0% of Cu, 13 to 16% of Si, 0.5% or less of Mg, 1.0% or less of Zn, 1.0% or less of Fe, and the remainder of Al, and exfoliated recessions of primary Si crystal exist on the inner surface of a cylinder bore. The large number of minute exfoliated recessions function as oil reservoir spots.

3 Claims, 5 Drawing Sheets

×200

×200

×400

×200

RECIPROCATING TYPE COMPRESSOR WITH IMPROVED CYLINDER BLOCK

This application is a continuation of application Ser. No. 08/261,829, filed Jun. 17, 1995, abandoned.

BACKGROUND OF THE INVENTION

1. Field of the Invention

The present invention relates to a reciprocating-type compressor for use as a car air conditioner, and more particularly relates to improvements for slidability in a cylinder block forming a cylinder bore.

2. Description of the Prior Art

Reciprocating type compressors are widely used for such as a car air conditioner. Among reciprocating-type compressors, for example, as illustrated in FIG. 1, a swash-plate-type compressor (referred to as a compressor hereinafter) disclosed in Japanese Unexamined Patent Publication (Kokai) No. 62-51776 is constructed as follows. A plurality of cylinder bores 8 are formed in both cylinder blocks 10, 12 in parallel with the shaft center, and a swash plate 16 is mounted on a drive shaft 14 supported by the cylinder blocks 10, 12. A piston 15 is mounted on the swash plate 16 through shoes 13, and the piston 15 is held in a cylinder bore 8 so that the piston 15 can be reciprocated in accordance with the inclination of the swash plate 16. Outside of both cylinder blocks 10, 12, front and rear housings 22, 24 are connected respectively through valve plates by through-bolts 26 which penetrate both cylinder blocks 10, 12. In the front and rear housings 22, 24, there are provided intake chambers 1, 2 communicating with the cylinder bores 8 through intake ports in the valve plate, and also there are provided outlet chambers 3, 4 communicating with the cylinder bores 8 through outlet ports in the valve plate.

In this compressor, when the drive shaft 14 is rotated, the swash plate 16 is rotated and simultaneously fluctuates in accordance with the inclination of the swash plate 16. Due to the fluctuating motion, the pistons 15 are reciprocated in the cylinder bores 8. Due to the foregoing, refrigerant gas in the suction chambers 1, 2 is drawn into the cylinder bores 8, and compressed there. After that, refrigerant gas is discharged into the outlet chambers 3, 4.

However, the cylinder blocks 10, 12 are generally made of an aluminum alloy such as ADC12 (JIS H5302, 1990). It has been made clear that the slidability between the piston 15 and cylinder bore 8 is not satisfactory under severe running conditions.

SUMMARY OF THE INVENTION

It is a problem to be solved by the present invention to secure the slidability between the piston and cylinder bore under severe running conditions.

In order to solve the above problem, the present invention has been accomplished to provide a reciprocating-type compressor having excellent slidability and abrasion resistance and a method for producing the same.

The summary of the present invention will be described below.

(1) A reciprocating-type compressor having excellent slidability and abrasion resistance, including a cylinder block provided with a plurality of cylinder bores and a piston, said piston reciprocating in said cylinder bore when a drive shaft is rotated, wherein said cylinder block comprises an aluminum alloy consisting essentially of, by weight, 1.5 to 5.0% of Cu, 13 to 16% of Si, 0.5% or less of Mg, 1.0% or less of Zn, 1.0% or less of Fe, and the remainder of Al as chemical compositions, and an inner surface of said cylinder bore is provided with exposure portions of primary Si crystals and portions of recessions formed by exfoliation of said primary Si crystals.

(2) The reciprocating-type compressor having excellent slidability and abrasion resistance according to item (1), wherein said exposure portion area ratio of said primary Si crystals on the inner surface of said cylinder bore is 10 to 60%.

(3) The reciprocating-type compressor having excellent slidability and abrasion resistance according to item (1), wherein said recessions formed by exfoliation of said primary Si crystals on the inner surface of said cylinder bore have a concave shape and act as oil reservoir spots.

(4) A method for producing a reciprocating-type compressor having excellent slidability and abrasion resistance, including a cylinder block provided with a plurality of cylinder bores and a piston, said piston reciprocating in said cylinder bore when a drive shaft is rotated, comprises the steps of;

producing said cylinder block by a diecasting process of an aluminum alloy consisting of, by weight, 1.5 to 5.0% of Cu, 13 to 16% of Si, 0.5% or less of Mg, 1.0% or less of Zn, 1.0% or less of Fe, and the remainder of Al as chemical compositions, primary Si crystals being precipitated on an inner surface of said cylinder bore in consequence of sufficiently cooling after casting, and recessions formed by exfoliation of said primary Si crystals being regulated by polishing said inner surface of said cylinder bore.

DESCRIPTION OF THE PREFERRED EMBODIMENT

Figure 1:
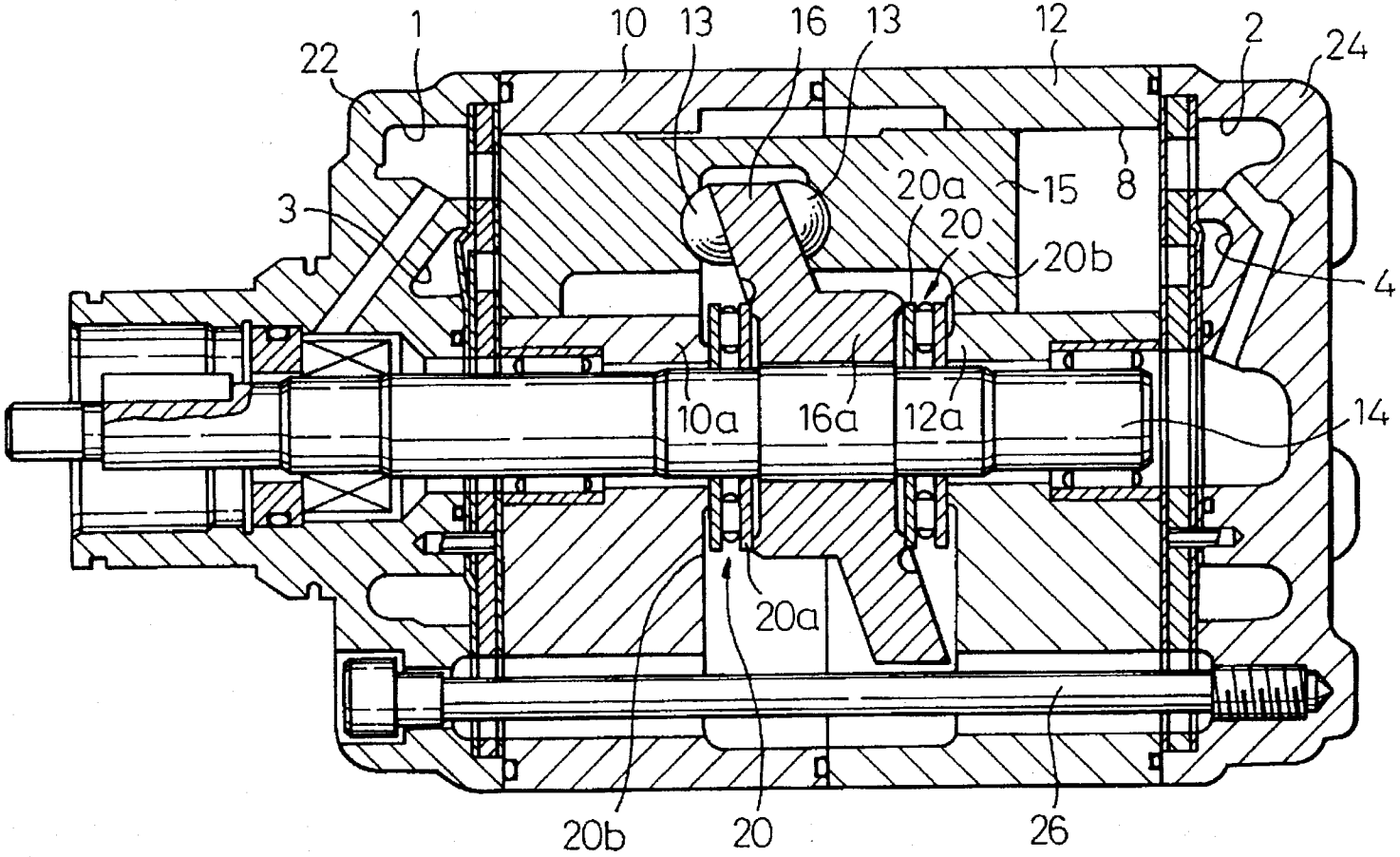
Fig.1 PRIOR ART
FIG. 1 is a longitudinal sectional view of the conventional swash-plate-type compressor.

The invention attains to improve slidability and abrasion resistance between a piston and an inner surface of a cylinder bore in a reciprocating-type compressor.

Namely, in the reciprocating-type compressor of the present invention, the cylinder block is made of aluminum alloy described above, and a large amount of primary Si crystal precipitates on the inner surface of the cylinder bore before polishing. A large number of minute recessions formed by exfoliation of primary Si crystals on the inner surface of the cylinder bore function as oil reservoir spots.

First, the chemical composition of the aluminum base alloy according the present invention will be described below.

When the Cu content is less than 1.5% by weight, the matrix except for primary Si crystals is too soft, and it is difficult to secure the strength. On the contrary, when the Cu content is more than 5.0% by weight, the matrix becomes too hard, and the action of the present invention can not be provided.

When the Si content is less than 13% by weight, it is similar to ADC12, and an amount of primary Si is small. Therefore, it is difficult to secure the strength, and the action of the present invention can not be provided. On the contrary, when the Si content exceeds 16% by weight, the castability deteriorates.

More, it is possible that Mg, Zn and Fe exist as impurities. The second technical feature of the present invention is the restriction of the exposure portion area ratio of the primary Si crystals on the inner surface of the cylinder bore.

The exposure portion area ratio is defined by the formula hereunder.

(Exposure portion area ratio of primary Si crystals %)=(Area of primary Si crystals substantially existing on the surface)×100÷(Area of primary Si crystals to exist on the surface as structures)

Even when diamond polishing is conducted as a means for forming exfoliated recessions of primary Si crystal, it is difficult to make an exposure portion area ratio of primary Si crystals to be less than 10%. When the exposure portion area ratio of primary Si crystals is less than 10%, abrasion resistance can not be sufficiently provided by the residual primary Si crystals. On the contrary, when the exposure portion area ratio of primary Si crystals exceeds 60%, an amount of exfoliated recessions is small so that the action of the present invention can not be provided.

When the Cu content is 1.5 to 5.0% by weight, a relatively soft matrix is formed. Therefore, primary Si crystals which are each independently projected from the pressure receiving sections, tend to be pushed into the base material by the outer ring of the thrust bearings coming into contact with the pressure receiving section. Consequently, the levels of primary Si crystals are easily made to be uniform. As a result, in this compressor, the interference and thrust load activated from the outer rings of the thrust bearings can be appropriately supported by a large number of primary Si crystals, and the jointly rotating motion and eccentric fluctuation can be appropriately supported by a large number of primary Si crystals under a severe operating condition. Accordingly, the abrasion resistance of the pressure receiving portion can be improved.

Example;

An embodiment of the present invention in which the present invention is applied to a swash-plate-type compressor (referred to as a compressor hereinafter) will be explained as follows.

The compressor of the present invention is the same as the conventional compressor shown in FIG. 1 except for the material composing a cylinder block. Therefore, the same reference numerals are used, and the compressor is explained with reference to FIG. 1.

The cylinder blocks 10, 12 of this compressor are made of aluminum alloy including 2.5% by weight (referred to as % hereinafter) of Cu, 15.0% of Si, 0.2% of Mg, 0.5% of Zn, 0.9% of Fe, and the remainder of Al. This aluminum alloy is subjected to die-casting under the casting condition shown in Table 1 so that the cylinder block is formed by monoblock forming.

TABLE 1

| Item of Condition | Value of Condition |
|---|---|
| Mold Clamp Force (Ton) | 630 |
| Casting Temperature (°C.) | 660 |
| Mold Temperature (°C.) | 130 |
| Gauge Pressure (kg/cm$^2$) | 300 |
| Plunger Rate (m/sec) | 2.5 to 3.0 |
| Chill Time (sec) | 8.5 |
| Shot Cycle (sec) | 50 |

As the Si content of the aluminum alloy of the present invention is not so high, it can be understood from the casting and mold temperatures shown in Table 1 that the casting operation can be easily carried out.

General properties of the aluminum alloy of the present invention formed by means of die-casting are shown in Table 2.

TABLE 2

| Characteristics | Value |
|---|---|
| Solidification Range (°C.) | 538 to 610 |
| Thermal Expansion Coefficient (/°C.) | $18.8 \times 10^{-6}$ |
| Tensile Strength (kg/mm$^2$) | 26.3 |
| Elongation (%) | 1.0 |
| Impact Value (kg · m/cm$^3$) | 0.4 to 0.7 |
| Hv Hardness | 85 to 116 |
| Specific Gravity (g/cm$^3$) | 2.7 |

According to the tensile strength, elongation, impact value and Hv hardness shown in Table 2, it can be understood that the matrix except for primary Si crystal of the aluminum alloy of the present invention is relatively soft. The reason is that the Cu content of the aluminum alloy of the present invention is relatively low.

In the cylinder blocks 10, 12 made of this aluminum alloy, a large amount of primary Si crystal precipitates on the inner surface of the cylinder bore 8 before polishing. The inner surface of the cylinder bore 8 is subjected to diamond polishing so that the exposure portion area ratio of primary Si crystal is made to be 15%. After that, the cylinder bore 8 is assembled to the compressor.

Evaluation;

As a comparative example, a compressor is prepared, in which the cylinder blocks 10, 12 are made of aluminum alloy of ADC12, and a sintered liner is inserted into the cylinder bore 8 and other components are the same as those of the compressor of the embodiment of the invention. Then an actual continuous running test is performed using the compressor of the embodiment and that of the comparative example, wherein the rotational speed is increased to a value at which sticking is caused between the piston 15 and cylinder bore 8. In each compressor, the piston 15 is constructed in such a manner that the main body, made of aluminum alloy, is coated with PTFE.

As a result of the test, the frequency of sticking of the compressor of the embodiment was about 20% higher than that of the compressor of the comparative example. In the compressor of the embodiment, a certain amount of primary Si crystal remained, so that abrasion resistance was sufficiently exhibited.

Figure 2:
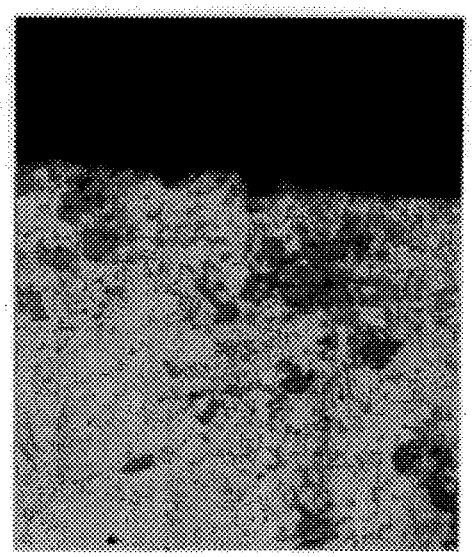
FIG. 2 is a microscopic photograph of 200 magnifications showing the metallic structure of the inner surface of the cylinder bore of the compressor of the embodiment.
Figure 3:
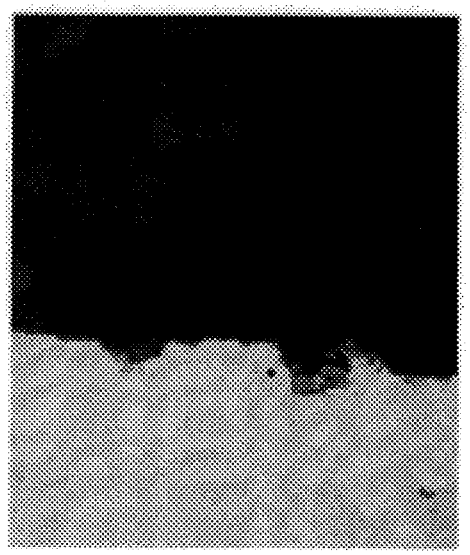
FIG. 3 is a microscopic photograph of 400 magnifications showing the metallic structure of the inner surface of the cylinder bore of the compressor of the embodiment.
Figure 4:
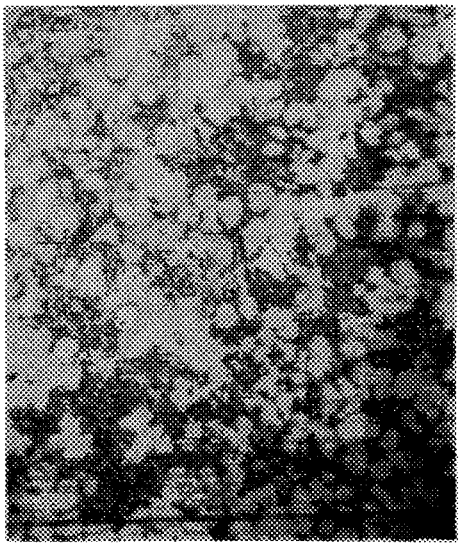
FIG. 4 is a microscopic photograph 200 magnifications showing the metallic structure of the inner surface of the cylinder bore of the compressor of the comparative example.

The metallic microstructure of the inner surface of the cylinder bore 8 of the compressor of the embodiment is shown in FIGS. 2 and 3. The metallic microstructure of the inner surface of the cylinder bore 8 of the compressor of the comparative example is shown in FIG. 4. FIG. 2 is a microscopic photograph of 200 magnifications. FIG. 3 is a microscopic photograph of 400 magnifications. FIG. 4 is a microscopic photograph of 200 magnifications.

From FIGS. 2 and 3, it can be seen that a large number of minute exfoliated recessions of primary Si crystals are formed on the inner surface of the cylinder bore 8 of the compressor of the embodiment, wherein the minute exfoliated recessions were formed when the primary Si crystals had exfoliated and fallen off in the process of diamond polishing.

Accordingly, the following can be seen from the result of the test. In the compressor of the embodiment, the exfoliated recessions functioned as oil reservoir spots. Therefore, even under a severe operating condition, excellent slidability was provided between the piston 15 and cylinder bore 8.

In the compressor of the embodiment, the abrasion amount of the pressure receiving sections 10*a*, 12*a* was only 20 μm. On the other hand, in the compressor of the comparative example, the abrasion amount of the pressure receiving sections 10*a*, 12*a* was 150 to 180 μm. The reason is as follows:

In the compressor of the embodiment, in the cylinder blocks 10, 12, a relatively soft matrix is formed except for primary Si crystal. Therefore, primary Si crystals which each independently project from the pressure receiving sections 10*a*, 12*a*, tend to be pushed into the base material by the outer rings 20*b* of the thrust bearings 20 coming into contact with the pressure receiving portions 10*a*, 12*a*. Consequently, the levels of primary Si crystals are easily made to be uniform. As a result, in this compressor, the interference and thrust load generated by the outer rings 20*b* of the thrust bearings 20 can be appropriately supported by a large number of primary Si crystals, and the jointly rotating motion and eccentric fluctuation can be appropriately supported by a large number of primary Si crystals under severe operating conditions.

In the compressor of the embodiment, unlike the compressor of the comparative example, it is not necessary to insert a liner into the cylinder bore 8, which is effective to reduce the weight of the compressor, and it is possible to reduce the number of parts.

In the compressor of the embodiment, the coefficient of thermal expansion of the cylinder blocks 10, 12 is similar to that of the pistons. Therefore, the side clearance between the cylinder blocks and the piston could be stabilized in actual operation.

Further, in the compressor of the embodiment, the amount of the casting strain in the cylinder blocks 10, 12 was so small that a dimensional change was small after the relief of residual stress.

Test 1;

Under the condition that the Cu content is 1 to 5.5% and other conditions are the same as those of the embodiment, the cylinder blocks 10, 12 are manufactured. The inner surface of the cylinder bore 8 is subjected to diamond polishing so that the exposure portion area ratio of primary Si crystal is 60%. After that the cylinder blocks 10, 12 are assembled to the compressor.

Each compressor was subjected to an actual endurance test, and an abrasion amount of the piston 15 or the cylinder bore 8 was measured. The result of the test is shown in FIG. 5.

Figure 5:
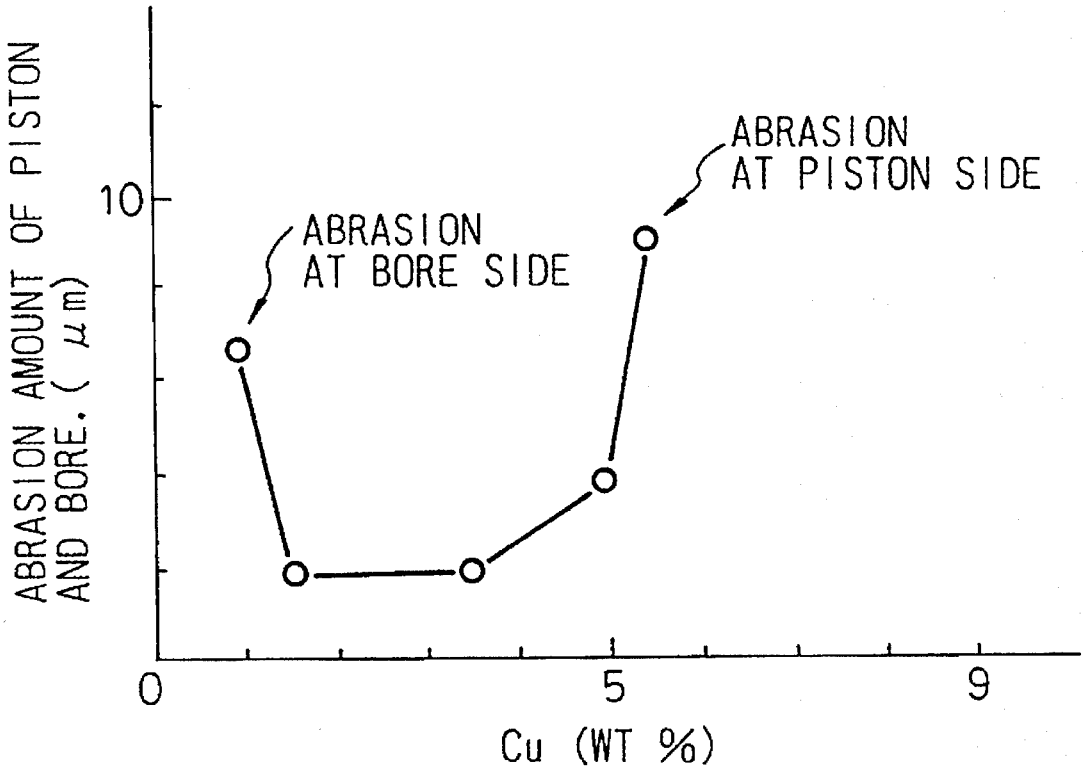
FIG. 5 is a graph showing a relation between the amount of Cu and the abrasion amount of the piston or the cylinder bore in Test 1.

The following can be seen from FIG. 5. When the Cu content is less than 1.5%, the cylinder bore 8 tends to wear away since the strength of the cylinder bore 8 is low. On the contrary, when the Cu content exceeds 5.0%, the cylinder bore 8 becomes too hard, so that the piston 15 tends to wear away.

Test 2;

Under the condition that the Cu content is 1.5% or 5% and other conditions are the same as those of the embodiment, the cylinder blocks 10, 12 are manufactured. The inner surface of the cylinder bore 8 is subjected to diamond polishing so that the exposure portion area ratio of primary Si crystal can be in a range from less than 10% to 70%. After that the cylinder blocks 10, 12 are assembled to the compressor.

Each compressor was subjected to an actual endurance test, and an abrasion amount of the piston 15 or the cylinder bore 8 was measured. The result of the test is shown in FIG. 6.

Figure 6:
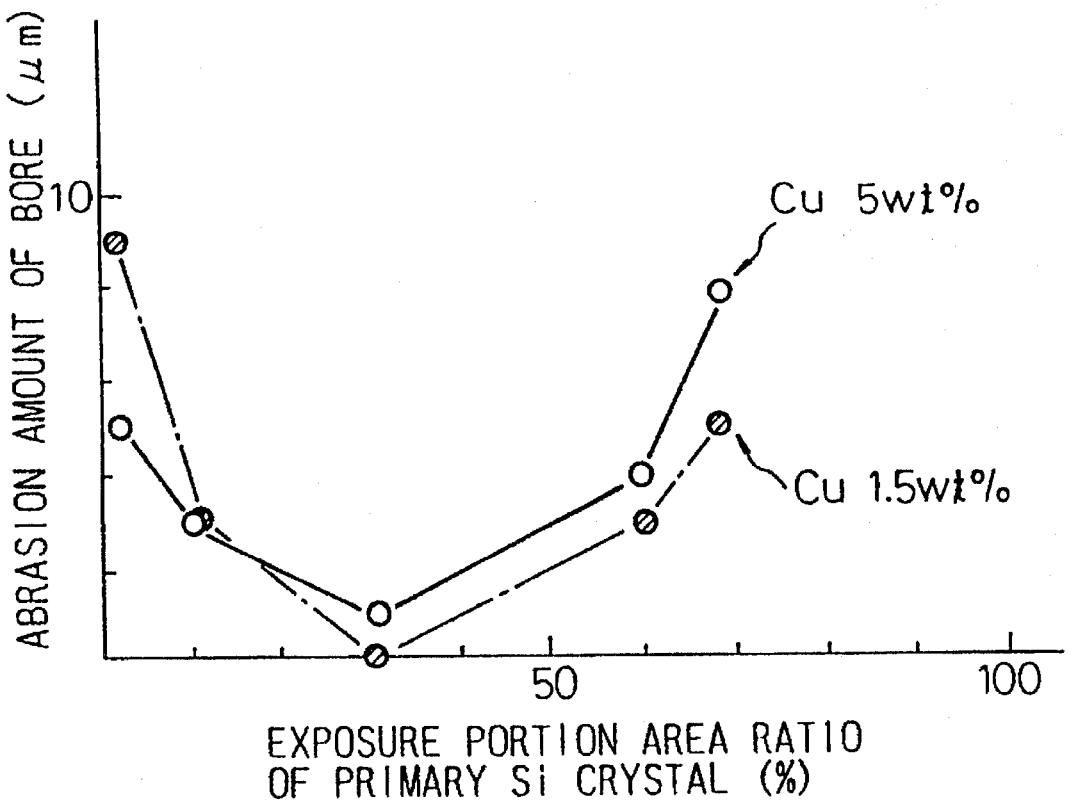
FIG. 6 is a graph showing a relation between the exposure portion area ratio of primary Si crystal and the abrasion amount of the cylinder bore in Test 2.

The following can be seen from FIG. 6. When the Cu content is 1.5% or 5%, it is difficult to provide abrasion resistance by the residual primary Si crystal in the case where the exposure portion area ratio of primary Si crystal is lower than 10%. Accordingly, the cylinder bore 8 tends to wear away. On the contrary, when the exposure portion area ratio of primary Si crystal exceeds 60%, the amount of exfoliated recessions is reduced, so that the cylinder bore 8 tends to wear away.

According to Tests 1 and 2, the following can be seen. When the construction described in the claims is adopted, the effect of the present invention can be provided even when consideration is given to the error caused in the process of mass production.

As described above in detail, in the reciprocating-type compressor of the present invention, the construction described in claims is adopted. Then, even under severe running conditions, excellent slidability can be provided between the piston and cylinder bore.

Consequently, this compressor exhibits an excellent endurance.

We claim:

1. A reciprocating-type compressor having excellent slidability and abrasion resistance, including a cylinder block provided with a plurality of cylinder bores and a piston, said piston reciprocating in said cylinder bore when a drive shaft is rotated, wherein said cylinder block comprises an aluminum alloy consisting essentially of, by weight, 1.5 to 5.0% of Cu, 13 to 16% of Si and the remainder of Al as chemical compositions, having a Vickers hardness of 85 to 116, and an inner surface of said cylinder bore is provided with exposure portions of primary Si crystals and portions of exfoliated recessions of said primary Si crystals and further said exposure portion area ratio of said primary Si crystals on the inner surface of said cylinder bore is 10 to 60%.

2. The reciprocating-type compressor having excellent slidability and abrasion resistance according to claim 1, wherein said exfoliated recessions of said primary Si crystals on the inner surface of said cylinder bore have a concave shape and effect as oil reservoir spots.

3. A method for producing a reciprocating-type compressor having excellent slidability and abrasion resistance, including a cylinder block provided with a plurality of cylinder bores and a piston, said piston reciprocating in said cylinder bore when a drive shaft is rotated, comprises the steps of;

producing said cylinder block by a die-casting process of an aluminum alloy consisting essentially of, by weight, 1.5 to 5.0% of Cu, 13 to 16% of Si, and the remainder of Al as chemical compositions, primary Si crystals being precipitated on an inner surface of said cylinder bore in consequence of sufficient cooling after casting, and exfoliated recessions of said primary Si crystals being regulated by polished said inner surface of said cylinder bore so that an exposure portion area ratio of said primary Si crystals on the inner surface of said cylinder bore is 10 to 60%.

* * * * *